US005457966A

United States Patent [19]

Nivens

[11] Patent Number: 5,457,966

[45] Date of Patent: Oct. 17, 1995

[54] THERMAL INTER-COOLER

[75] Inventor: Jerry W. Nivens, Truth or Consequences, N.M.

[73] Assignee: 1069380 Ontario, Inc., Canada

[21] Appl. No.: 174,222

[22] Filed: Dec. 27, 1993

Related U.S. Application Data

[63] Continuation of Ser. No. 762,627, Sep. 19, 1992, Pat. No. 5,289,699.

[51] Int. Cl.[6] ..... F25B 41/00

[52] U.S. Cl. ..... 62/513; 62/113

[58] Field of Search ..... 62/513, 113

*Primary Examiner*—Ronald C. Capossela
*Attorney, Agent, or Firm*—Gregory W. Carr

[57] ABSTRACT

The invention comprises a non-restrictive, constant pressure refrigerant recycling and cooling unit that interrupts the normal refrigerant cycle to permit a lower temperature liquid to enter the expansion device, and thus provide a lower temperature, and therefore a lower pressure gas for delivery to the inlet side of the compressor, which acts to reduce the energy requirement and cost to operate the compressor. This reduction in pressure and temperature also results in lower operating costs and lower maintenance costs and utilizes less refrigerant quantity requirements.

3 Claims, 6 Drawing Sheets

THERMAL INTER-COOLER

This application is a continuation of Ser. No. 07/762,627 filed Sep. 19, 1992, now U.S. Pat. No. 5,289,699.

FIELD OF THE INVENTION

This invention relates to a thermal inter-cooler of use in any type of refrigeration system that employs a liquid and gas refrigerant. In most instances, similar systems would employ a compressor to compress and pressurize a refrigerant gas, such as freon, which would then be condensed into a partial liquid and gaseous state, and be directed into a housing through a series of restricted nozzles, where it would expand and cool and experience a pressure drop and then recondense as a somewhat denser liquid in the bottom of the housing before exiting through the outlet on its way to an expansion valve ahead of the evaporator, whereat the refrigerant enters the expansion device as a somewhat cooler liquid, but also as an imperfect liquid and gas mixture in such prior systems.

BRIEF DESCRIPTION OF THE PRIOR ART

Many prior attempts have been made to create an efficient and economical device (sometimes called a subcooler) for use in refrigeration systems, but each has included certain drawbacks and limitations in their performance, such as intentionally inserted restrictions, i.e., nozzles that restrict and interrupt the smooth flow of refrigerant and create a larger than necessary back pressure. The present invention includes improved structural and conceptual parts that permit its performance and results to approach the optimum for the purpose intended.

In U.S. Pat. No. 4,207,749, to Lavigne, entitled Thermal Economized Refrigeration System, employs a series of nozzles to deliberately maintain a pressure drop in his refrigerant line, and his condenser and economizer each require a separate source of cool fluid to circulate therethrough.

U.S. Pat. No. 4,683,726, to Barron, entitled Refrigeration Apparatus, also requires the use of a plurality of restrictive nozzles in his subcooler, and further requires that his subcooler be located in the cold air stream from the evaporator.

The Kann U.S. Pat. No. 4,773,234, also includes flow restricting nozzles to intentionally produce a pressure drop between the subcooler and the receiver.

The Helmer U.S. Pat. No. 4,807,449 discloses a latent heat economizing device having a shell which is air cooled by the atmosphere, and containing a closed and distributor extending the full length of the shell with orifices in a hot refrigerant line closed at its distal end.

SUMMARY OF THE INVENTION

An object of this invention is to provide a structure for a refrigeration system thermal "intermediate" cooler that does not include any imposed restrictions in the refrigerant path through the system that would physically cause a pressure drop across this unit.

Another object is to provide a heat transfer path for the refrigerant to traverse that provides a substantial length and area of metal to metal contact between the line carrying the hot refrigerant liquid and the line carrying the cool expanded refrigerant gas.

A further object is to provide a dual stage cooler for the hot refrigerant gas without the inclusion of any inserted physical restrictions in the refrigerant line.

Yet another object of this invention is to provide a device of this type comprising a cooling shell into which the liquid and gas refrigerant expands and permits liquid only to collect in the lower portion of the shell and be withdrawn to feed into an expansion device in a condition known in the trade as a "liquid seal".

A still further object of this invention is to provide an improved thermal inter-cooler and refrigeration system employing same, wherein the structural and system modifications described hereafter result in measurable improvements in performance and efficiency.

An additional object is to provide a vapor buffer inside of the outer shell of the thermal inter-cooler that calms the turbulence of the liquid and vapor within the interior of the inter-cooler housing adjacent the exit port of the inter-cooler.

Another object is to provide a vapor buffer within the inter-cooler housing that also assists in condensing the vapor circulating therein.

An additional object is to provide a series of exit ports in the liquid/vapor inlet line of the inter-cooler causing increased mixing of the liquid and vapor refrigerant within the inter-cooler, to promote condensation of the vapor within the inter-cooler. Such exit ports are preferably large enough in area to avoid imposing a restriction to the flow of refrigerant.

A further object is to alter the location of the cool medium line from a central axial line above the liquid level to a position below the liquid level, so that it is substantially submerged within the cool liquid.

And yet another object is to provide a relocation of the inter-cooler within the refrigeration system to a position downstream of, and closely adjacent the expansion device, to take advantage of the shortened connections and the improved heat exchange using the expansion device output in the cold medium line.

A still further object is to provide a unique end cap for the inter-cooler which facilitates construction and allows liquid to exit from the inter-cooler at the lowest available point, regardless of whether the inter-cooler is mounted in a horizontal position, in a vertical position with the end cap at the lowest position, or when mounted at any position therebetween.

Yet another object of this invention is to allow selection of length of the conformed portion of the incoming liquid/vapor line to result in desired BTU transfer.

An additional object of the invention is to provide an inter-cooler and heat exchange system in which heat is removed from refrigerant passing through the inter-cooler, utilizing a cooling medium external to the refrigeration system, such as available water supply, chilled water and the like.

And another object is to provide a device of the previous object in which the inter-cooler will perform without appreciable drop in performance even when the shell is filled with liquid or when it is three-fourth empty of liquid.

DESCRIPTION OF THE DRAWINGS

FIG. 3 is a cross-section taken along the lines of 3—3 of

FIG. 2;

DETAILED DESCRIPTION

Figure 1:
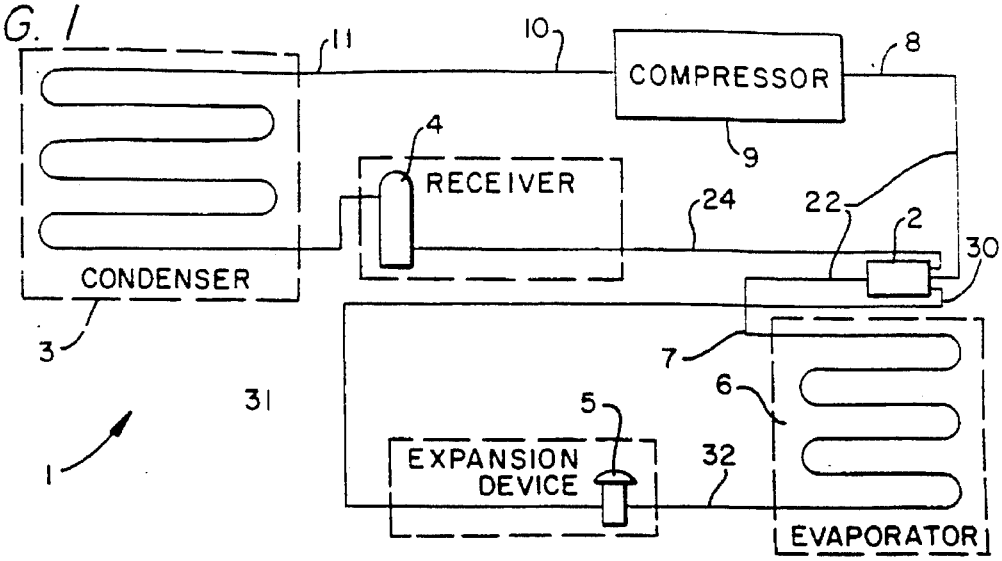
FIG. 1 is a schematic diagram of a first configuration of a typical refrigerant system which employs the thermal inter-cooler of this invention.

Referring now more particularly to the characters of reference of the drawing, it will be observed that FIG. 1 schematically depicts a refrigeration system 1 including the thermal inter-cooler 2 of this invention interposed between the condenser 3, the optional receiver 4, and the expansion device 5 at the evaporator 6, and wherein the outlet line 7 from the evaporator passes through the cooler 2 and thence to the inlet or suction side 8 of the compressor 9. The low pressure, low temperature refrigerant gas from the evaporator 6 (through the inter-cooler 2) enters the compressor at 8 in a relatively low temperature, low pressure state, and then exits the compressor at line 10 in a relatively hotter temperature and relatively higher pressure when it enters the condenser 3 at inlet 11.

Figure 2:
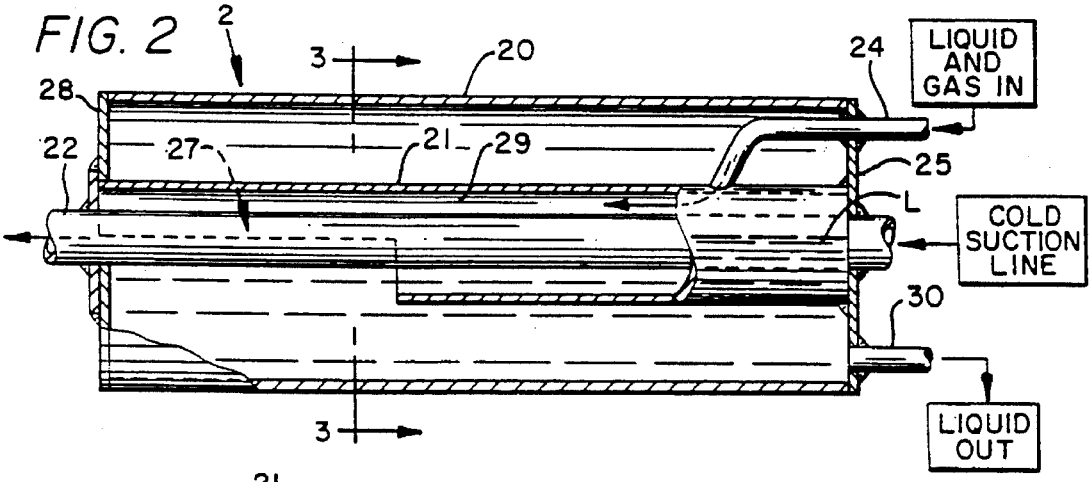
FIG. 2 is a partially sectioned view of one embodiment of the inter-cooler of this invention.

In FIG. 2, the first embodiment of the thermal condenser 2 is seen to comprise an outer shell 20 of a good thermal conducting metal such as aluminum, copper, steel or other known materials. The large central axial pipe or tube 21 is of a smaller diameter than the shell 20, and may be concentrically installed therein. Another good heat conducting material tube 22 extends axially and also concentrically through the shell 20 and pipe 21 and comprises the outlet line 7 that traverses from the evaporator 6 to compressor inlet 8. The inlet line 24 from the condenser/receiver enters through the right end plate 25 of cooler 2, and engages the top side of pipe 21 in such a manner that fluid travelling through the line 24 expands into the annular space 29 between pipe 21 and tube 22 until it exits at the cutaway portion 27 before reaching left end plate 28. Upon exiting from the annulus 29, any entrapped gas condenses into liquid and combines with the liquid in the line and fills the lower portion of shell 20 and exits therefrom through outlet 30 as a "liquid seal" L, without entrapped gas. This total condensation is due in part to the expansion of the mixture out through the cutaway 27, and in part due to the close contact with the cold suction line 22, and in part to contact of the fluid with the inner wall of the shell 20, which is installed in a cold ambient location.

Liquid refrigerant proceeds from outlet 30 through line 31 to expansion device 5, which is normally a valve, and through line 32 to evaporator 6, wherein the liquid is converted into a lower temperature and lower pressure gas that passes through cooler 2 via tube 22 on its way to the suction side of compressor 9 via its intake opening 8. The utilization by the compressor 8 of a lower than the normal intake pressure (and temperature) will result in a lower power requirement by the compressor, which translates into greater efficiency and lower cost, and this feature has been confirmed by tests and charts of "before" and "after" installations.

Figure 3:
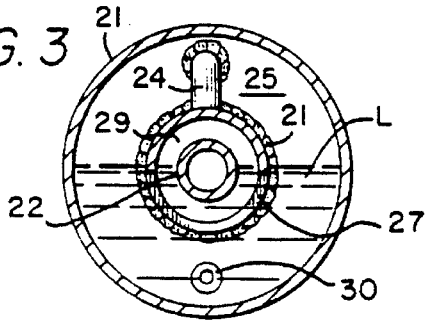

In FIG. 3, the liquid L is shown to have a liquid level slightly above the centerline of the concentric structures. It has been found, however, that this inter-cooler 2 will function very satisfactorily when the liquid level is in the range from 100% full to 75% empty. The dimensional difference between the inner diameter of pipe 21 and the outer diameter of tube 22, is of the order of one-eighth of an inch in one preferred embodiment, so that inlet fluid in the annular space 29 is in a very efficient heat transferring relationship with cold tube 22, pipe 21 and the cooler liquid L.

Figure 4:
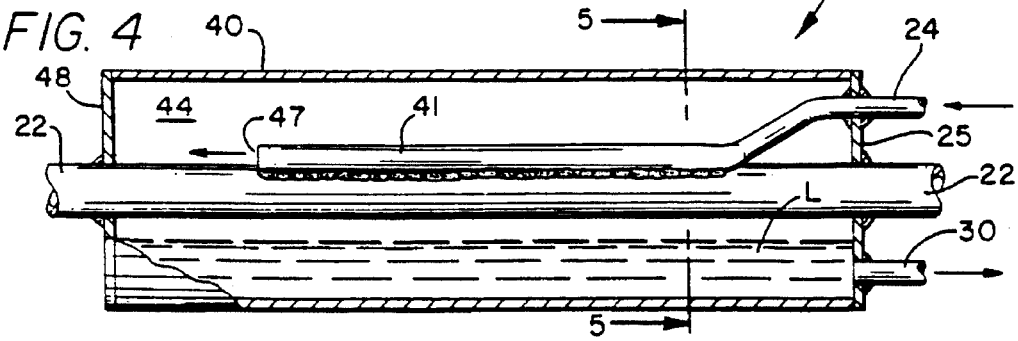
FIG. 4 is a cross-sectional view of a second embodiment of this invention.

FIG. 4 represents a preferred embodiment of this thermal inter-cooler 2A, wherein the inlet line 24 converts into an expanded generally oval shaped tube 41, with open end 47 to permit exit of the entering gas and liquid to spray into the open area 44 of shell 40, whereupon any gas in the entering mixture condenses upon contact with the cold tube 22, the cool inner wall of shell 40, and end walls 48 and, or the cooler liquid L, so that the exiting fluid at 30 will be a "liquid seal", identified here as L. The long extended metal to metal contact between tube section 41 and the cold center tube 22 may best be seen in FIG. 5. This intimate continuous contact for a considerable length is a key reason for the success of this particular embodiment over the prior art. A non-analogous comparison of this phenomenon, is that the heat in the hot refrigerant tube 24 appears to be magnetically attracted into the cold suction tube 22. End plate 48 of this embodiment snugly surrounds the exiting cold tube 22, as contrasted to the end plate 28 of embodiment 2.

Figure 6:
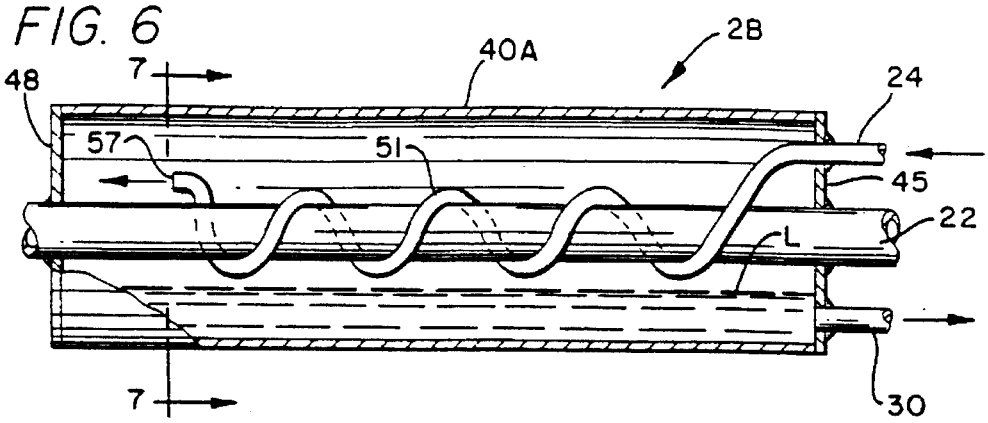
FIG. 6 is a cross-sectional view of a third embodiment of this invention.
Figure 7:
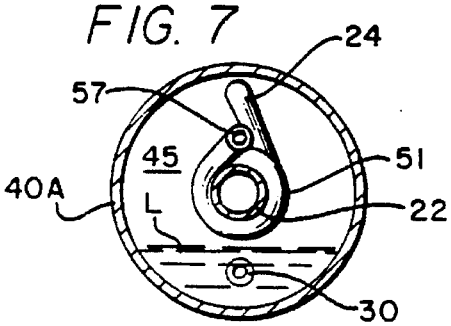
FIG. 7 is a cross-section taken along the lines of 7—7 of FIG. 6.

Embodiment 2B of FIG. 6 differs from the embodiments of FIGS. 2 and 4, in that it provides for a much longer travel path for the incoming fluid mixture via line 24 that is spirally wound at 51 around the center cold tube 22, before the fluid exits at 57 as a mixture of gas and liquid into the large open interior enclosed by shell 40A and end plates 48 and 45. The gas content of the exiting fluid immediately condenses on contact with the inner wall of shell 40A, end plates 45 or 48, the cold center tube 22, or the cooler liquid L in the lower area of shell 40A. The liquid seal L exiting at 30, proceeds through line 31 to expansion device 5 to rejoin the total refrigeration system 1. FIG. 7 is an axial section showing the interior of embodiment 2B of FIG. 6. The spiral configuration 51 of fluid inlet tube 24 entering into the shell 40A is determined by weighing the factors of providing the maximum area of heat transfer contact against the increased friction imposed in the travel path of the incoming fluid through a long and tortuous route to reach exit 57. This, of course, is one of the advantages of the embodiment 2A, which utilizes a long but straight travel path to its exit 47.

Figure 8:
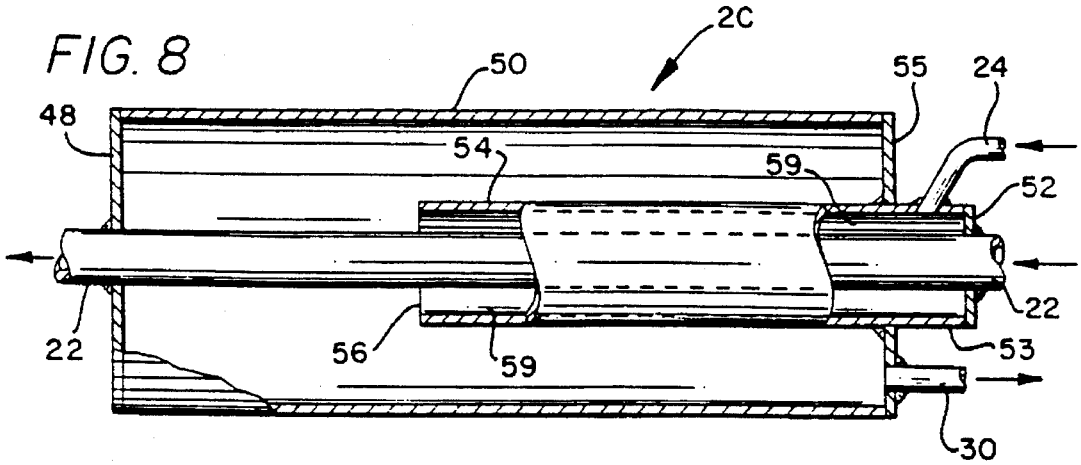
FIG. 8 is a partially cross-sectioned view of a fourth embodiment of this invention.

In FIG. 8, the details of embodiment 2C may be observed to include an outer shell 50 having end plates 48 and 55, which permit the passage therethrough of center cold tube 22. End plate 55, additionally permits the entrance and passage of pipe 51 concentrically of both shell 50 and center tube 22. End plate is attached by welding or otherwise to extension 53 and end plate 52 is likewise attached to tube 22 to provide an enclosure seal for fluid entering through tube 24. The incoming fluid fills the annular region 59 of the cantilever suspended pipe 54, and proceeds to the open exit end 56, whereupon it expands and any gas therein condenses and fills the lower part of shell 50 with liquid seal (not shown in this view), as a portion of said liquid seal exits through outlet tube 30 back into the refrigeration cycle.

Figure 9:
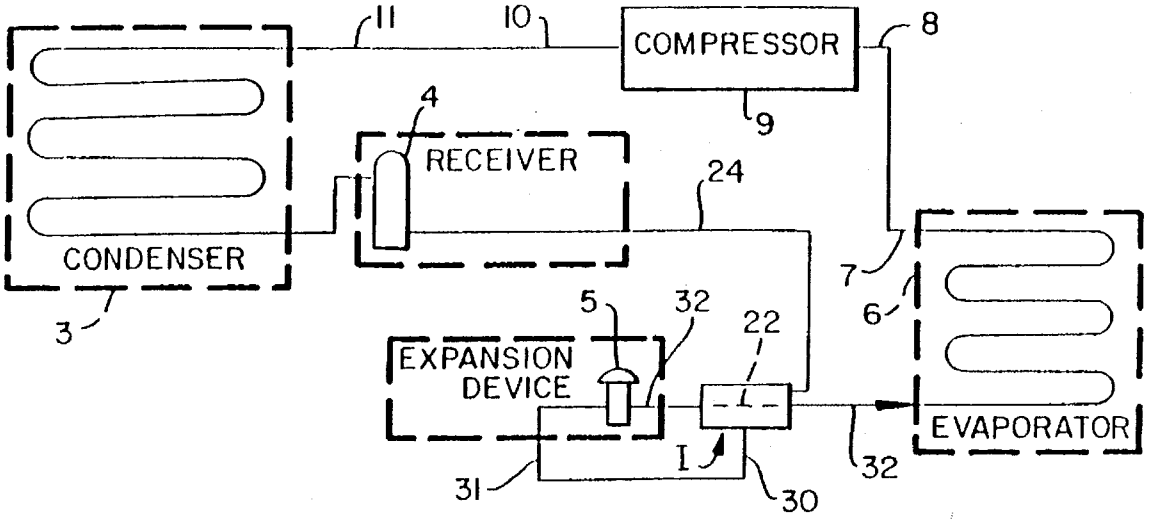
FIG. 9 is a schematic diagram of a second configuration of a typical refrigeration system which employs the improved thermal inter-cooler of this invention.

FIG. 9 discloses an alternative placement of the inter-cooler embodiments of FIGS. 2, 4, 6, 8 or 10, in a typical refrigeration system. This schematic diagram contrasts with the diagram of FIG. 1, in that an inter-cooler I, representing any of the embodiments of the invention, is installed upstream of the evaporator 6 and downstream of the expansion device 5. Relatively warm refrigerant is introduced to the inter-cooler I by the line 24. Refrigerant cooled within the inter-cooler I then exits via the line 30 and is directed next to the expansion device 5 by the line 31. The exit line 32 from the expansion device 5 enters directly into the cold medium line 22 of the inter-cooler I. Cold refrigerant then exits the inter-cooler I, from line 22 to the evaporator 6. The inter-cooler I is preferably positioned in close proximity to the evaporator 6. Placement of the inter-cooler I as shown facilitates installation within refrigeration systems in which placement of the inter-cooler I between the evaporator 6 and compressor 9 is difficult or impractical.

FIGS. 10, 11, 12 and 13 disclose an inter-cooler 2D, comprising a preferred embodiment of the invention. The construction of this embodiment employs the same type of outer shell 40, end wall 48, cold medium line 22, contained liquid L, open area 44 and open end 47, as described in embodiment 2A of FIG. 4. Aspects differing substantially include placement of the cold medium line 22, variation of the length "V"of the tube portion 41D, use of an end cap 25D, placement of the exit port 30D, modification of the tube portion 41D with transverse slots or slits "S", and addition of a buffer 60.

In the embodiment 2D, the length "V" of the tube portion 41D of line 24 that surrounds or overlays line 22 is selected to provide the desired amount of heat transfer between refrigerant in lines 24 and 22. The area of contact between the lines 22 and 24 increases as the length "V" increases and, conversely, decreases with a decrease in the length "V". Because heat transfer increases with increased contact area, increasing the length "V" will increase heat transfer, while decreasing the length "V" will conversely reduce heat transfer.

Heat transfer may also be varied by adjusting the distance separating the open end 47 of the line 24 from the end wall 48. Reducing the distance causes refrigerant exiting through the open end 47 to impinge more violently against the end wall 48, thus causing greater turbulence and mixing of the liquid and vapor, thereby increasing heat transfer. The opposite effect of reduced heat transfer is achieved by increasing the distance between the open end 47 and the end wall 48.

Heat transfer is increased in the inter-cooler 2D by formation at or near the distal and open end 47 of line 24 of a series of transverse slots or slits "S". The slits "S"permit vapor and liquid refrigerant from within line 24 to spray into the interior 44 of the inter-cooler 2D, impinging against the end walls 44, cap 25D, inner side of shell 40, cold line 22, and/or the liquid L, thereby causing turbulent mixing of the liquid and vapor which, again, enhances condensation of the vapor, and adds to the quantity of liquid L formed in the bottom portion of shell 40. The slits "S" are of sufficient size so as not to impose a significant restriction to the flow of refrigerant into the inter-cooler 2D. One method of forming the slits "S" is by use of a band saw to cut the slits in the tube portion 41D. While only two slits "S" are shown, it will be appreciated that the number-of slits "S" used is not restricted to two, but may be varied to achieve the desired heat transfer.

Although the primary purpose of the slits "S" is to enhance heat transfer, the slits also create a barrier of spray which calms and slows the turbulent flow of refrigerant, which tends to violently splash off the end wall 48 and flow toward the exit port 30D. Calming and slowing the flow of refrigerant toward the exit line 30D reduces the possibility of vapor discharging from the inter-cooler 2D through the exit line 30D, by allowing the vapor to rise to the surface of the liquid refrigerant prior to discharge. This feature enhances the efficiency of the inter-cooler 2D by reducing the possibility of refrigerant vapor entering the expansion device 5.

The length "V" of the tube portion 41D, the distance of open end 47 from the end wall 44 and the number of slits "S" in line 24 can be selected in combination to achieve the desired heat transfer.

Figure 5:
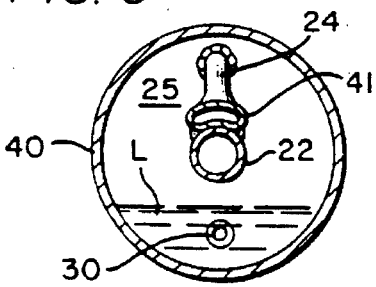
FIG. 5 is a cross-section taken along the lines of 5—5 of FIG. 4.
Figure 10:
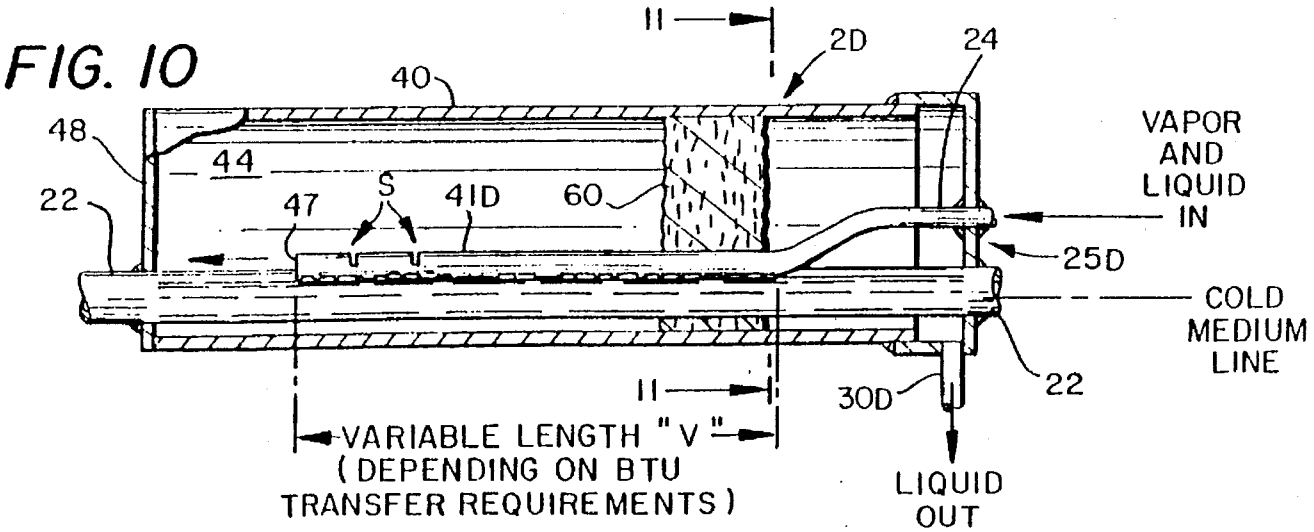
FIG. 10 is a cross-sectional view of a preferred embodiment of the instant invention.
Figure 11:
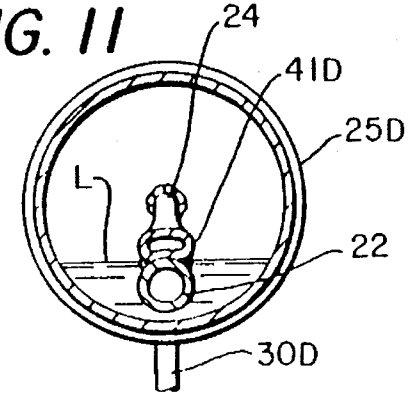
FIG. 11 is a cross-sectional view taken along the lines 11—11 of the preferred embodiment shown in FIG. 10.
Figure 13:
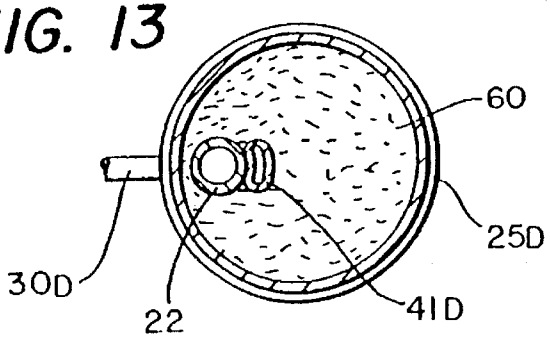
FIG. 13 is a cross-sectional view taken along the lines 13—13 of the preferred embodiment shown in FIG. 12.

The position of line 22 within the inter-cooler 2D differs from that of the embodiment shown in FIGS. 4 and 5, in that, as is best shown in FIGS. 10 and 11, line 22 is positioned adjacent the exit port 30D and aligned with the shell 40 of the inter-cooler 2D. Location of the line 22 adjacent the exit line 30D causes submergence of at least a portion of line 22 below the level L of refrigerant contained within the inter-cooler 2D. Increased contact between the line 22 and refrigerant effectively increases cooling of the refrigerant and condensation of vapor within the inter-cooler 2D. The line 22 is preferably placed so that the liquid level L coincides with the intersection of the tube portion 41D and the line 22, as is shown in FIG. 11. This orientation also positions the exit opening 47 of line 22 and slits "S" above the liquid level L, thereby reducing back pressure to the flow of refrigerant into the inter-cooler 2D.

In contrast with the inter-cooler 2A of FIGS. 4 and 5, the inter-cooler 2D includes a cup-shaped cap 25D that facilitates construction and enhances operation. The cap 25D slips over the end of the inter-cooler 2D through which the line 22 is introduced. The cap 25D is preferably manufactured from materials similar to the shell 40. The cap 25D is preferably positioned over the end of the inter-cooler 2D and both sealed and secured by welding; however, it will be apparent that other suitable means of sealing and securing the cap, such as thermal sealing, gluing, and the like may be used, if desired.

Lines 22 and 24 extend through the cap 25D and are secured and sealed in place, preferably by welding or other suitable means, such as those by which the end cap 25D is secured and sealed on the inter-cooler 2D. Formed in end cap 25D is an exit port 30D, through which refrigerant exits into line 30 of the refrigeration systems shown in FIGS. 1 or 9. The exit port 30D is located immediately adjacent the wall of the end cap 25D through which the lines 22 and 24 extend.

A buffer 60, made of loosely woven metal mesh, is positioned within the inter-cooler 2D. The buffer 60 is doughnut-shaped. The buffer 60 surrounds both line 22 and tube portion 41D, and abuts the adjacent interior surface of the shell 40. The buffer 60 provides a section of relatively calm refrigerant within the inter-cooler 2D adjacent the exit line 30D, which is separated from the relatively turbulent flow of refrigerant from the open end 47 and slits "S" of line 24. Providing relatively calm refrigerant adjacent the exit line 30D minimizes, if not avoids, passage of vapor into the exit line 30D, thereby enhancing the "liquid seal" provided by the inter-cooler 2D. In addition, the metal mesh of the buffer 60 is thermally conductive, thereby aiding in the transfer of heat from and condensation of the vapor within the inter-cooler 2D.

Figure 12:
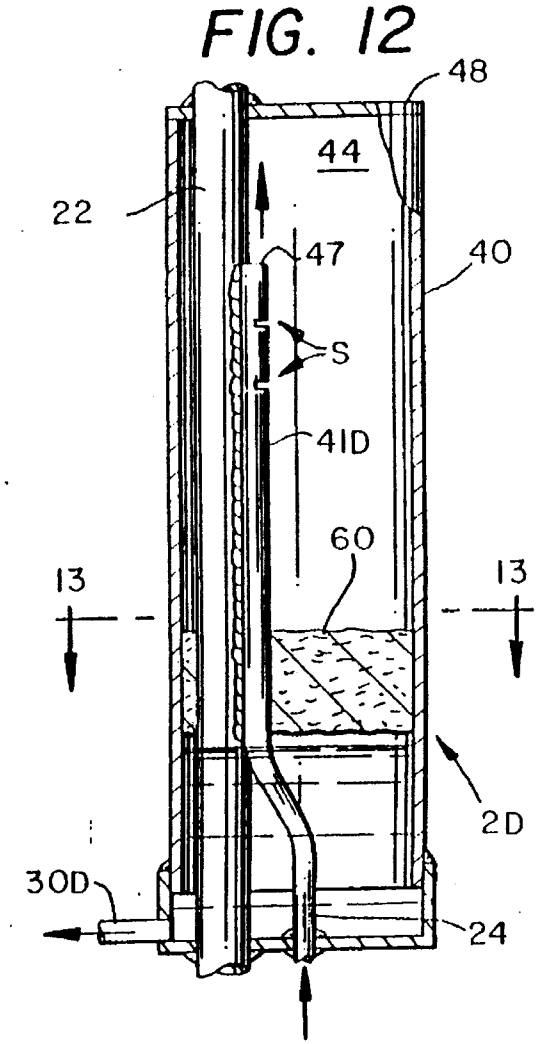
FIG. 12 is a cross-sectional view of the preferred embodiment of the invention of FIGS. 10 and 11, wherein the inter-cooler is oriented vertically.

The inter-cooler 2D may be installed in virtually any orientation from the horizontal, as shown in FIG. 10, to the vertical, as shown in FIG. 12. It will be apparent that placement of the exit line 30D in the end cap 25D is such that the inter-cooler can be positioned at any angle with exit line 30D always located at substantially the lowest point within the inter-cooler 2D, including the horizontal position, the vertical position, or any intermediate angle. This capability insures a "liquid seal" within the inter-cooler 2D and concommitment increased efficiency, by causing any liquid contents of the inter-cooler 2D to cover the exit port 30D.

It will be apparent that utilization of the buffer 60 within the inter-cooler 2D will also serve the dual purpose of promoting condensation of vapor and formation of a relatively calm section of refrigerant adjacent the exit port 30D, when the inter-cooler 2D is installed in the horizontal position shown in FIG. 10, the vertical position shown in FIG. 12, or any intermediate orientation.

It will therefore be apparent that the performance of the inter-cooler 2D will not be substantially affected, whether the unit is installed horizontally, vertically, or at any angle therebetween, so long as the exit port 30D is positioned at the lowest drainage or exit point in the unit.

Figure 14:
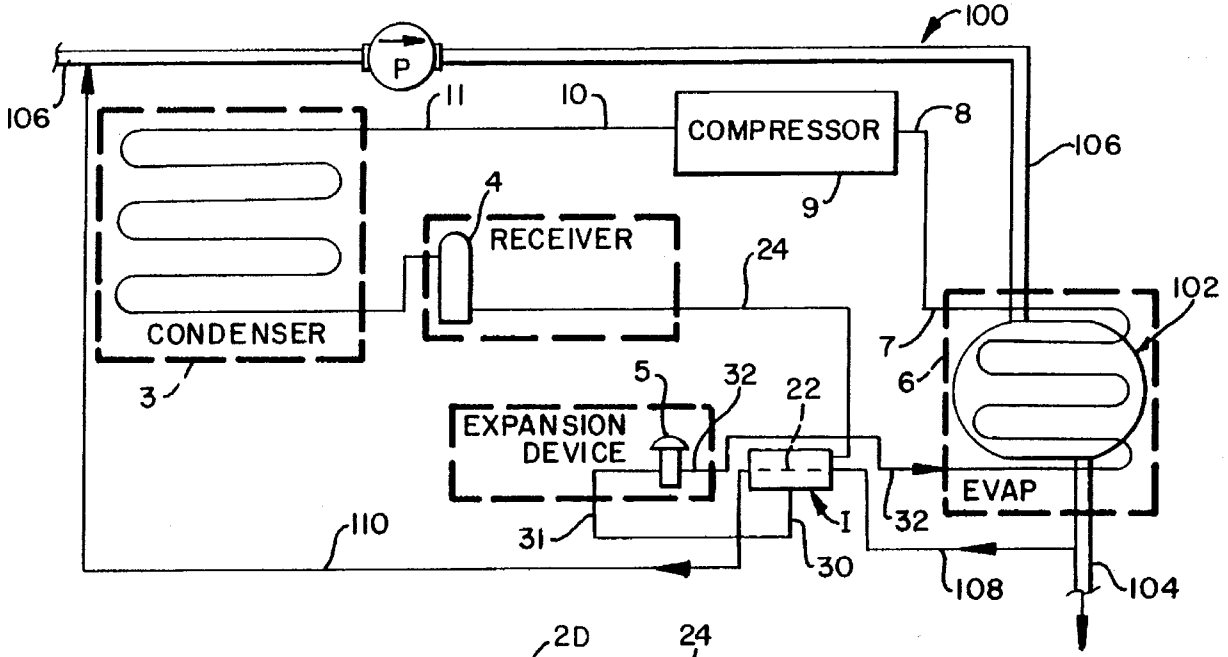
FIG. 14 is a schematic diagram showing the thermal inter-cooler of this invention, utilizing a coolant supplied by a secondary cooling system to cool refrigerant within the inter-cooler.

FIG. 14 illustrates an alternative use of an inter-cooler I in a refrigerant system 100, incorporating a secondary cooling system that chills water and transports the chilled water to a remote location for cooling. Such systems are often utilized, for example, where a single, centralized cooling system services a number of separate buildings within a complex, such as a university, manufacturing complex, and the like. The inter-cooler I utilized in the system may comprise any of the embodiments shown in FIGS. 2, 4, 6, 8 or 10. Components having substantially the same structure and operation as those depicted in the refrigerant systems of FIGS. 1 and 9 are identified in FIG. 14 by the same reference numeral.

In the secondary cooling system of refrigerant system 100, a water tank 102 contains water to be chilled and then to be transported for cooling remote office buildings and the like, at remote locations. Water within the tank 102 is chilled by the coils of the evaporator 6, with refrigerant received from the expansion device 5 through a line 32. Chilled water is transported from the water tank 102, to remote locations, through an exit line 104. Water is returned to the tank 102, from the remote locations cooled, through a line 106. Water is circulated through the system by a pump "P", in line 106.

The insulation of the inter-cooler I in refrigerant system 100 differs from the systems previously described, in that the medium used to cool refrigerant within the inter-cooler I is chilled water received from the exit line 104 of the secondary cooling system. Specifically, a desired amount of chilled water exiting the tank 102 through the line 104 is diverted to line 22 of the inter-cooler I by a line 108. The flow rate of the chilled water directed through line 22 of the inter-cooler I may be selected as one of a number of variables, to reach the desired heat transfer from the refrigerant within the inter-cooler I. Water from the line 22 of the inter-cooler I is then returned to the water line 106, by a return line 110, for recirculation through the chilled water tank 102.

Figure 15:
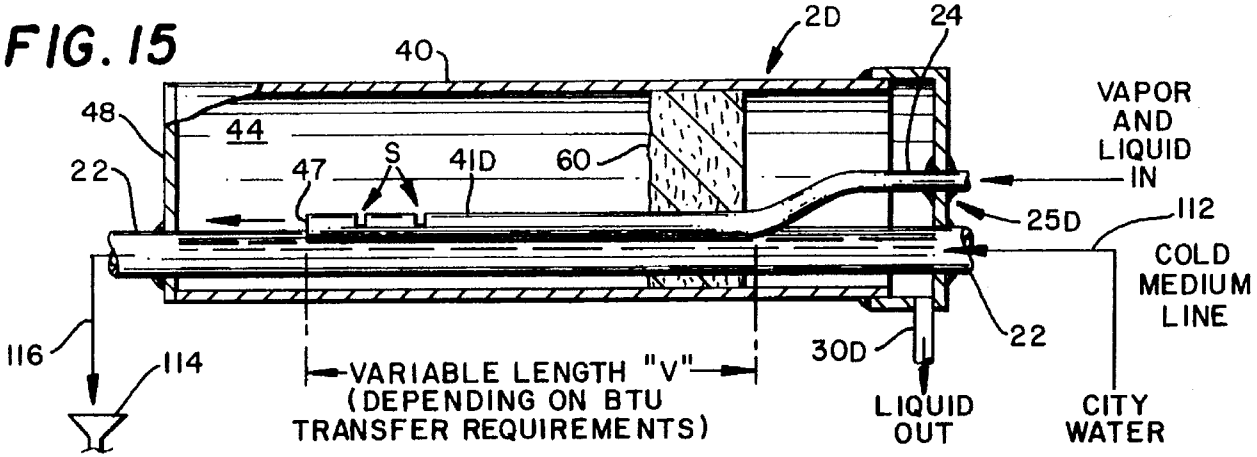
FIG. 15 is a schematic diagram showing the thermal inter-cooler of this invention, utilizing a coolant supplied by another secondary cooling system to cool refrigerant within the inter-cooler.

FIG. 15 illustrates use of any of the inter-cooler embodiments shown in FIGS. 2, 4, 6, 8 and 10, with a secondary cooling system in which "City Water," received from the local water utility at ambient temperature, is utilized to cool refrigerant received by the inter-cooler. Although the embodiment of inter-cooler 2D is shown specifically in FIG. 15, it will be apparent that the other inter-cooler embodiments disclosed can be utilized in a similar fashion, with a local water supply.

The inter-cooler 2D is connected to a line 112, delivering water at ambient temperature from a local water supply. Water from the line 112 passes through the cold line 22 of the inter-cooler 2D, providing a relatively cooler medium for removing heat from refrigerant received within the inter-cooler 2D through the inlet tube 24. Water exits the inter-cooler 2D to a drain 114, through a line 116. The drain 114 returns the spent water to a local drainage system.

Figure 16:
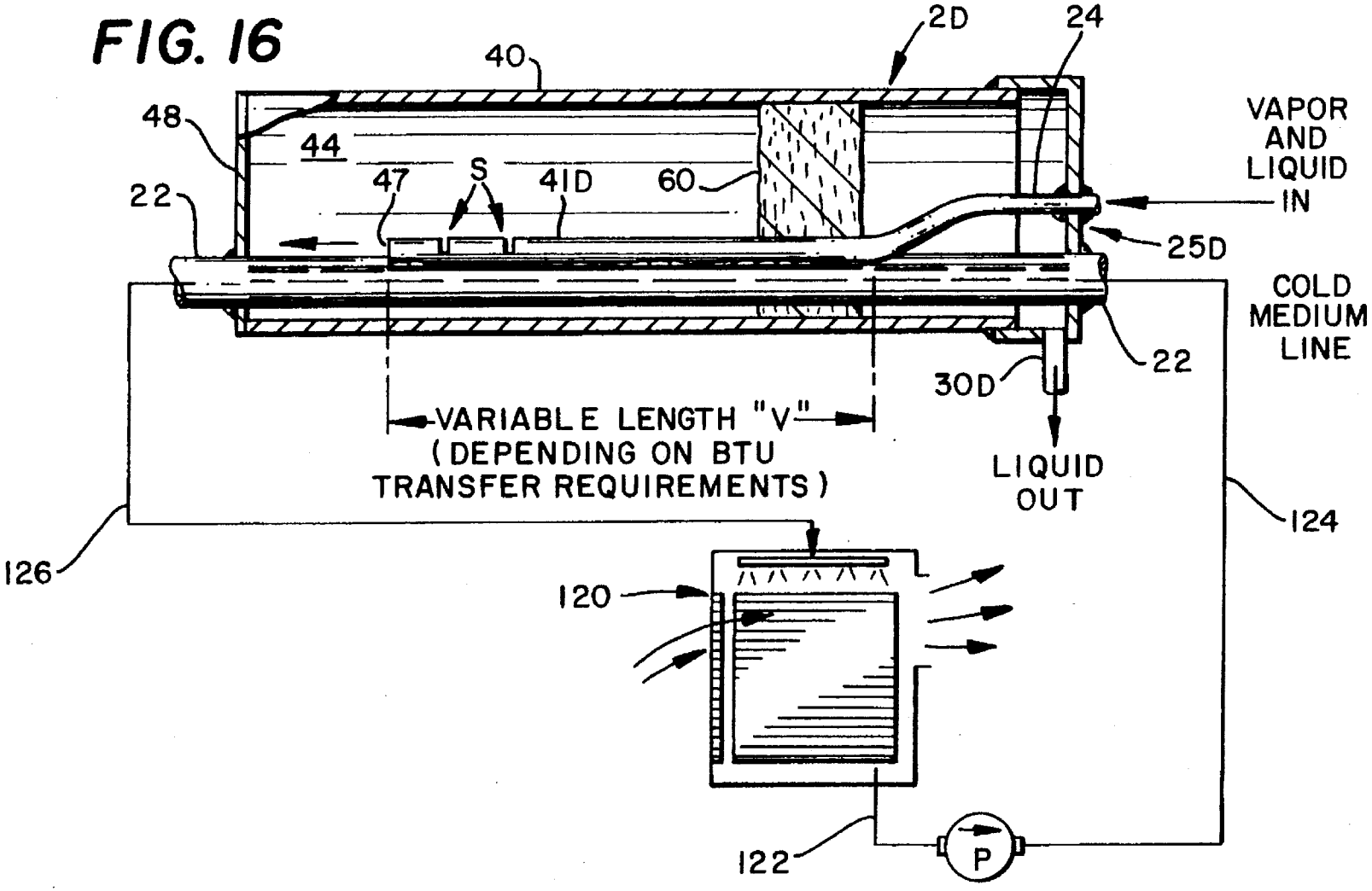
FIG. 16 is a schematic diagram showing the thermal inter-cooler of this invention, utilizing a coolant supplied by yet another secondary cooling system for cooling refrigerant within the inter-cooler.

FIG. 16 illustrates another secondary cooling system for use with any of the inter-cooler embodiments shown in FIGS. 2, 4, 6, 8 and 10, supplying cooled water received from a water tower, swamp cooler, or other similar cooling device, to remove heat from refrigerant. While the embodiment of inter-cooler 2D is shown in FIG. 16, it will be apparent that the other inter-cooler embodiments disclosed may be used with the secondary cooling system shown, in the same fashion.

The refrigerant system includes a swamp cooler 120 for chilling water. Chilled water exits the swamp cooler 120 through a line 122, and is then pumped to the cold line 22 of the inter-cooler 2D through a line 124, by pump P. Water exiting the line 22 of the inter-cooler 2D is then returned to the swamp cooler 120 by a line 126. The flow rate and temperature of water introduced to the inter-cooler 2D through the line 124 is selected to amongst other variables of the system, to achieve the desired heat transfer within the inter-cooler 2D.

It will be apparent that the secondary cooling systems of FIGS. 14, 15 and 16 may be utilized in conjunction with any of the disclosed inter-coolers, positioned within refrigeration systems similarly to inter-coolers 2 or 2D, as shown in FIGS. 1 and 9. While the secondary cooling systems shown in FIGS. 14, 15 and 16 show passage of water through the cold refrigerant line 22 in the same direction as the relatively warmer refrigerant entering through line 24, it will be apparent that the secondary cooling systems may be rearranged easily to direct water through the line 22, in the opposite direction.

Although a preferred embodiment of the thermal inter-cooler of the present invention has been illustrated in the accompanying Drawings and described in the foregoing Detailed Description, it will be understood that the invention is not limited to the embodiment disclosed but as their structure and function fall within the scope of the appended claims.

I claim:

1. In a refrigeration system comprising a compressor, a condenser, an expansion device, and an evaporator connected in series, an improvement comprising a thermal inter-cooler having a substantially hollow housing formed of a substantially cylindrically shaped wall with first and second enclosed ends to define a substantially enclosed interior within the housing, a cold medium line passing through the first and the second enclosed ends of the housing, a refrigerant line extending into said housing through either the first end or second end for discharging refrigerant into the open interior of said housing, the refrigerant condensing and collecting in the bottom of the interior of the housing, and a discharge opening defined in the housing; wherein the refrigerant line is coupled to an outlet of the condenser to receive warm refrigerant, the discharge opening is coupled to an inlet of the expansion device and the cool medium line is connected between an outlet to the expansion device and an inlet to the evaporator.

2. The system of claim 1 wherein the discharge opening is aligned with the wall of the housing and adjacent either the first end or the second end of the housing, resulting in the opening positioned substantially near the lowest gravitational point of the housing for enhancing removal of collected refrigerant when the housing is substantially in either of two operating positions oriented at right angles with respect to each other.

3. The system of claim 2 wherein the inter-cooler is further comprised of a vapor buffer occupying at least a portion of the interior area of the housing to define within the housing an unrestricted area into which the refrigerant is discharged by the refrigerant line and a restricted portion for reducing turbulence in the liquid and vapor refrigerant mixture after discharged from the refrigerant line into the housing.

* * * * *